US009337533B2

(12) United States Patent
Grandfield et al.

(10) Patent No.: US 9,337,533 B2
(45) Date of Patent: May 10, 2016

(54) GROUND PLANE MEANDERING IN Z DIRECTION FOR SPIRAL ANTENNA

(71) Applicant: The Charles Stark Draper Laboratory, Inc., Cambridge, MA (US)

(72) Inventors: John E. Grandfield, St. Petersburg, FL (US); Phillip Hulse, Tampa, FL (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 99 days.

(21) Appl. No.: 14/454,983

(22) Filed: Aug. 8, 2014

(65) Prior Publication Data

US 2016/0043464 A1 Feb. 11, 2016

(51) Int. Cl.
*H01Q 1/36* (2006.01)
*H01Q 1/48* (2006.01)

(52) U.S. Cl.
CPC ... *H01Q 1/48* (2013.01); *H01Q 1/36* (2013.01)

(58) Field of Classification Search
CPC ..... H01Q 1/36
USPC ..... 343/895
See application file for complete search history.

(56) References Cited

U.S. PATENT DOCUMENTS

| | | | | |
|---|---|---|---|---|
| 3,618,114 | A | 11/1971 | Dietrich | 343/895 |
| 3,633,210 | A | 1/1972 | Westerman et al. | 343/895 |
| 4,675,690 | A | 6/1987 | Hoffman | 343/895 |
| 6,023,250 | A | 2/2000 | Cronyn | 343/895 |
| 8,922,452 | B1 | 12/2014 | O'Brien et al. | H01Q 1/36 |
| 2013/0194159 | A1 | 8/2013 | Alexopoulos et al. | 343/895 |

OTHER PUBLICATIONS

Kaiser, *The Archimedean Two-Wire Spiral Antenna*, IRE Transactions on Antennas and Propagation, vol. 8, pp. 312-323, May 1960.
Wheeler, *On the Radiation from Several Regions in Spiral Antennas*, IRE Transactions on Antenna and Propagation, pp. 100-102, Jan. 1961.
Drewniak et al., *A Log-Spiral, Radiating-Line Antenna*, IEE AP-S International Symposium Digest, pp. 773-776, 1986.
Kuo et al., *A compact microstrip antenna with meandering slots in the ground plane*, Microwave and Optical Technology Letters, vol. 29, Issue 2, pp. 95-97, Apr. 20, 2001 (Abstract only).
Caswell, *Design and Analysis of Star Spiral with Application to Wideband Arrays with Variable Element Sizes*, Ph.D. thesis, Virginia Polytechnic Institute, Chapter 2, 51 pages, Dec. 14, 2001.

(Continued)

*Primary Examiner* — Graham Smith
(74) *Attorney, Agent, or Firm* — Sunstein Kann Murphy & Timbers LLP

(57) ABSTRACT

An antenna has a spiral driven element that meanders in a z direction, perpendicular to the x-y plane of the spiral, and a ground plane that also meanders in the z direction, such that spacing between the ground plane and the driven element is an odd multiple of one-quarter wavelength, along at least a portion of the length of the driven element. The spacing promotes constructive interference from signals reflected by the ground plane, increasing the front-to-back ratio of the antenna and, thereby, providing gain. The ground plane of a wideband version of the spiral antenna meanders, such that the spacing varies between about an odd multiple of one-quarter wavelength of an upper frequency to about an odd multiple of one-quarter wavelength of a lower frequency of a frequency range, thereby providing gain over a range of frequencies.

9 Claims, 6 Drawing Sheets

(56) References Cited

OTHER PUBLICATIONS

Filipovic et al., *Broadband meanderline slot spiral antenna*, IEE Proc. Microw. Antennas Progag., vol. 149, No. 2, pp. 98-105, Apr. 2002.

Kramer et al., *Size Reduction of a Low-Profile Spiral Antenna Using Inductive and Dielectric Loading*, IEEE Antennas and Wireless Propagation Letters, vol. 7, pp. 22-25, 2008.

Kakoyiannis et al., *Small Square Meander-line Antennas with Reduced Ground Plane Size for Multimedia WSN Nodes*, IEEE, Antennas and Propagation, EuCAP 2009, 3rd European Conference, Mar. 23-27, 2009, pp. 2411-2415.

Guraliuc et al., *Numerical Analysis of a Wideband Thick Archimedean Spiral Antenna*, IEEE Antennas and Wireless Propagation Letters, vol. 11, pp. 168-171, Mar. 2012.

Vinayagamoorthy et al., *Microstrip to Parallel Strip Balun as Spiral Antenna Feed*, Queensland University of Technology, Brisbane, Australia, 6 pages, 2012.

Lee et al., *Flexible Spiral Antenna with Microstrip Tapered Infinite Balun for Wearable Applications*, IEEE Antennas and Propagation Society Symposium (APSURSI), 2 pages, Jul. 2012.

Wang et al., *Spiral Antenna Cuts Low Profile to 9.4 GHz*, Microwaves & RF, vol. 51, Issue 11, 10 pages, Nov. 13, 2012.

Agarwal et al., *Wideband Square Microstrip Antenna using Meandered Finite Ground Plane*, International Journal of Computer Applications (0975-8887), vol. 68, No. 9, pp. 43-45, Apr. 2013.

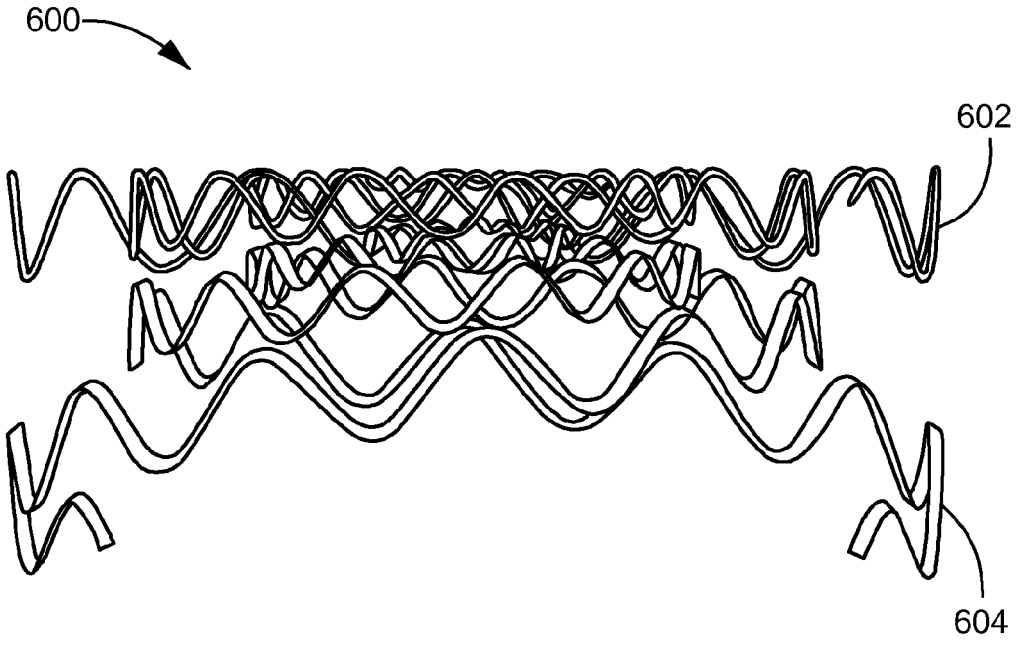
*FIG. 6*
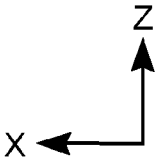

Section A-A

GROUND PLANE MEANDERING IN Z DIRECTION FOR SPIRAL ANTENNA

TECHNICAL FIELD

The present invention relates to spiral radio frequency antennas and, more particularly, to spiral antennas with meandering ground planes.

BACKGROUND ART

An antenna, also known as an aerial, is an electronic device that converts electric power into radio waves and vice versa. Antennas are used to transmit and/or receive radio frequency (RF) signals. An antenna element is an electrically conductive member of an antenna. Various arrangements of antenna elements are known, such as dipole, monopole, Yagi, spiral and helix, each arrangement having a characteristic radiation pattern, impedance, etc. For example, spiral antennas may be used where wide bandwidths are required. In addition, spiral antennas inherently transmit circularly polarized radio waves and can receive linearly polarized signals, regardless of the linear polarization orientation.

A spiral antenna may include a flat ground plane or a lossy cavity behind, and spaced apart from, its spiral element(s) to change the antenna's radiation pattern to be unidirectional. The ground plane reflects signals back toward the spiral elements. If the ground plane is spaced one-quarter of a wavelength from the driven spiral elements, the reflected signal constructively interferes with signals radiated by the driven spiral elements, providing gain. However, this gain is theoretically realized for only a single frequency, whose wavelength is used to determine the spacing, as well as harmonics of the frequency. Practically, the gain may be realized over a relatively small range of frequencies.

A conical ground plane spaced apart from a planar driven element has different spacings at different radial distances from the center of the ground plane, thereby providing a range of spacings. This range can encompass one-quarter wavelengths for a range of frequencies, thereby providing gain over the range of frequencies. (Caswell, Eric D., "Design and Analysis of Star Spiral with Application to Wideband Arrays with Variable Element Sizes," Dec. 14, 2001, citing Drewniak, J., et al., "A log-spiral, radiating-line antenna," 1986.)

Driven elements in some spiral antennas are corrugated in a z direction, rather than flat. For example, U.S. patent application Ser. No. 14/221,467, "Periodic Spiral Antenna," filed Mar. 21, 2014 by O'Brien, et al. (referred to hereinafter as "O'Brien") and assigned to the assignee of the present application, describes a cavity-backed spiral antenna with periodic sinusoidally corrugated driven elements. O'Brien's cavity has a flat bottom. O'Brien notes that sinusoidal valleys of the driven elements would be close to the top edge of a wall of a conventional cavity, thereby causing power loss to the grounded cavity. O'Brien's cavity wall has a sinusoidal top edge, shaped the same as the driven element at the outer edge of the spiral, to reduce this power loss.

SUMMARY OF EMBODIMENTS

An embodiment of the present invention provides an antenna. The antenna includes a spiral driven element wound about a z axis. The spiral driven element meanders in a z direction. The antenna also includes a ground element parallel to the driven element. The ground element meanders in the z direction, including in a region intermediate an outside edge of the ground element and the z axis.

The ground element may meander in the z direction along at least a portion of a length of the spiral driven element.

The antenna may have a design frequency. The ground element may be spaced apart from the driven element a distance equal to about an odd multiple of one-quarter wavelength at the design frequency.

The design frequency may include a range of frequencies extending from a lower frequency to an upper frequency. The distance between the ground element and the driven element may vary along the spiral driven element. The distance between the ground element and the driven element at any location along the spiral driven element may be equal to about an odd multiple of one-quarter wavelength of a frequency between the upper frequency and the lower frequency.

The distance between the ground element and the driven element may vary monotonically and continuously along the spiral driven element.

The distance between the ground element and the driven element may vary monotonically and in steps along the spiral driven element.

The design frequency may include a range of frequencies extending from a lower frequency to an upper frequency. The distance between the ground element and the driven element may vary along the spiral driven element. For each frequency of a plurality of frequencies between the lower frequency and the upper frequency, the distance between the ground element and the driven element may be equal to about an odd multiple of one-quarter wavelength of the frequency at one or more locations along the spiral driven element.

The distance between the ground element and the driven element may vary monotonically and continuously along the spiral driven element.

The distance between the ground element and the driven element may vary monotonically and in steps along the spiral driven element.

The design frequency may include a range of frequencies extending from a lower frequency to an upper frequency. The distance between the ground element and the driven element may vary along the spiral driven element. The distance may vary between about an odd multiple of one-quarter wavelength of the upper frequency to about an odd multiple of one-quarter wavelength of the lower frequency.

The antenna may also include a dielectric material, other than air, disposed between the ground element and the driven element. The ground element may be attached to the dielectric material across at least a portion of the ground element's surface area. The driven element may be attached to the dielectric material along at least a portion of the driven element's length. The dielectric material may maintain the distance between the ground element and the driven element.

BRIEF DESCRIPTION OF THE DRAWINGS

The invention will be more fully understood by referring to the following Detailed Description of Specific Embodiments in conjunction with the Drawings, of which:

FIG. 6. is a side schematic view of a meandering spiral antenna having a ground plane that meanders in a z direction, according to another embodiment of the present invention.

DETAILED DESCRIPTION OF SPECIFIC EMBODIMENTS

Definitions

As used herein, the following terms shall have the following meanings, unless the context indicates otherwise.

"Meander" means follow a path that both increases and decreases in displacement from a flat reference plane that is parallel to, i.e., does not intersect, the path. Meander does not describe a path that monotonically increases or monotonically decreases in displacement. For example, a conic ground plane does not meander.

A "plane of a driven element" means an imaginary flat surface on which the driven element lies or a flat zero reference surface, above and below which the driven element meanders, such as according to a sinusoidal function.

Spiral antennas, according to embodiments of the present invention, provide gain over a wide bandwidth. Such an antenna has a spiral driven element that meanders in a z direction, perpendicular to an x-y plane of the spiral. The antenna has a ground plane that also meanders in the z direction, such that spacing between the ground plane and the driven element is an odd multiple of one-quarter wavelength, along at least a portion of the length of the driven element. This spacing promotes constructive interference between signals reflected by the ground plane and signals radiated by the driven element, thereby increasing a front-to-back ratio of the antenna, thus providing gain. In a wideband version of the spiral antenna, the ground plane meanders in the z direction, such that the spacing varies along at least a portion of the length of the driven element, thereby providing one-quarter wavelength (or an odd multiple thereof) spacing over a range of frequencies and, therefore, gain over the range of frequencies.

Figure 1:
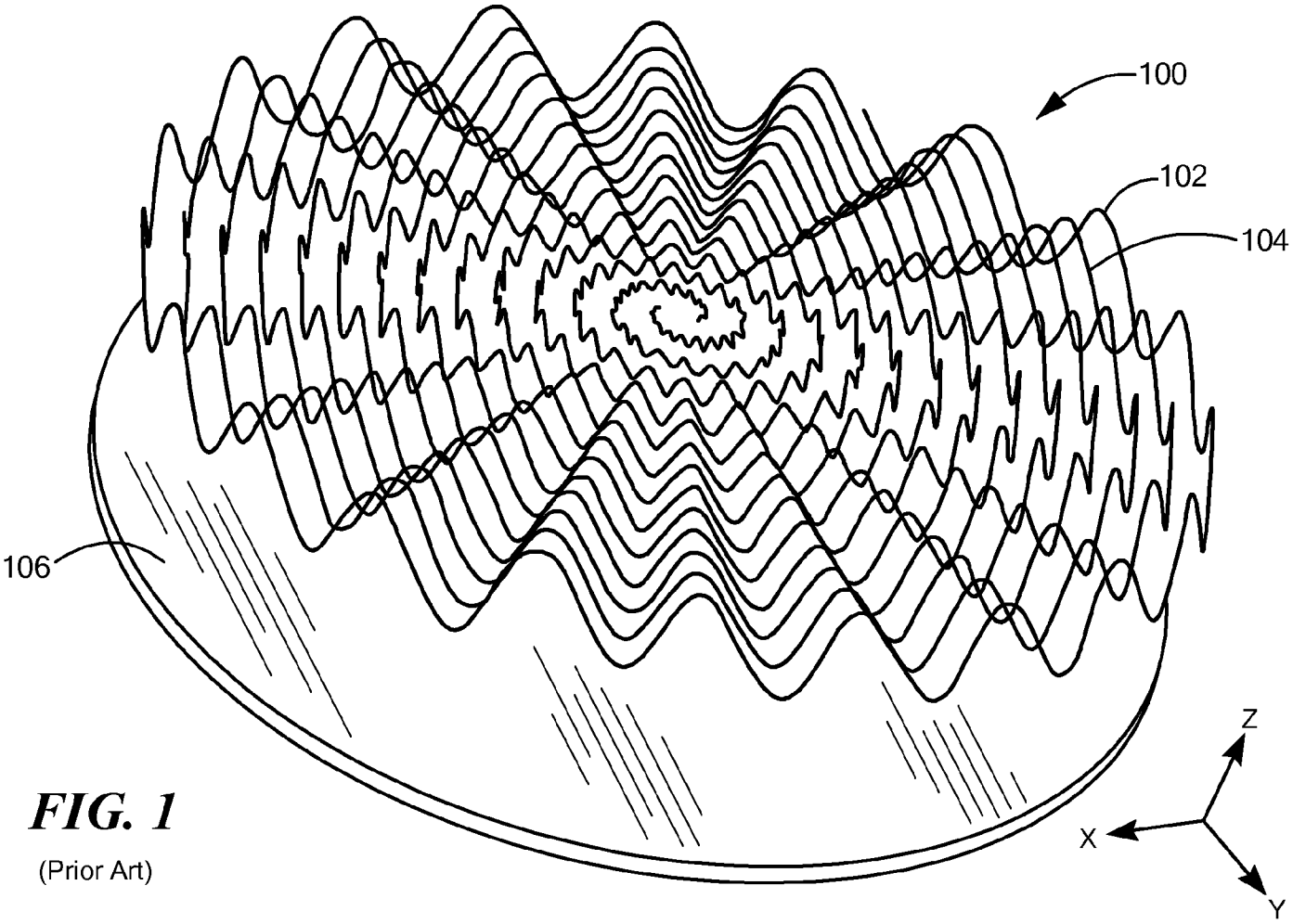
FIG. 1 (Prior Art)
FIGS. 1 and 2 are perspective and top schematic views, respectively, of a meandering spiral antenna having a planar ground plane, according to the prior art.
Figure 2:
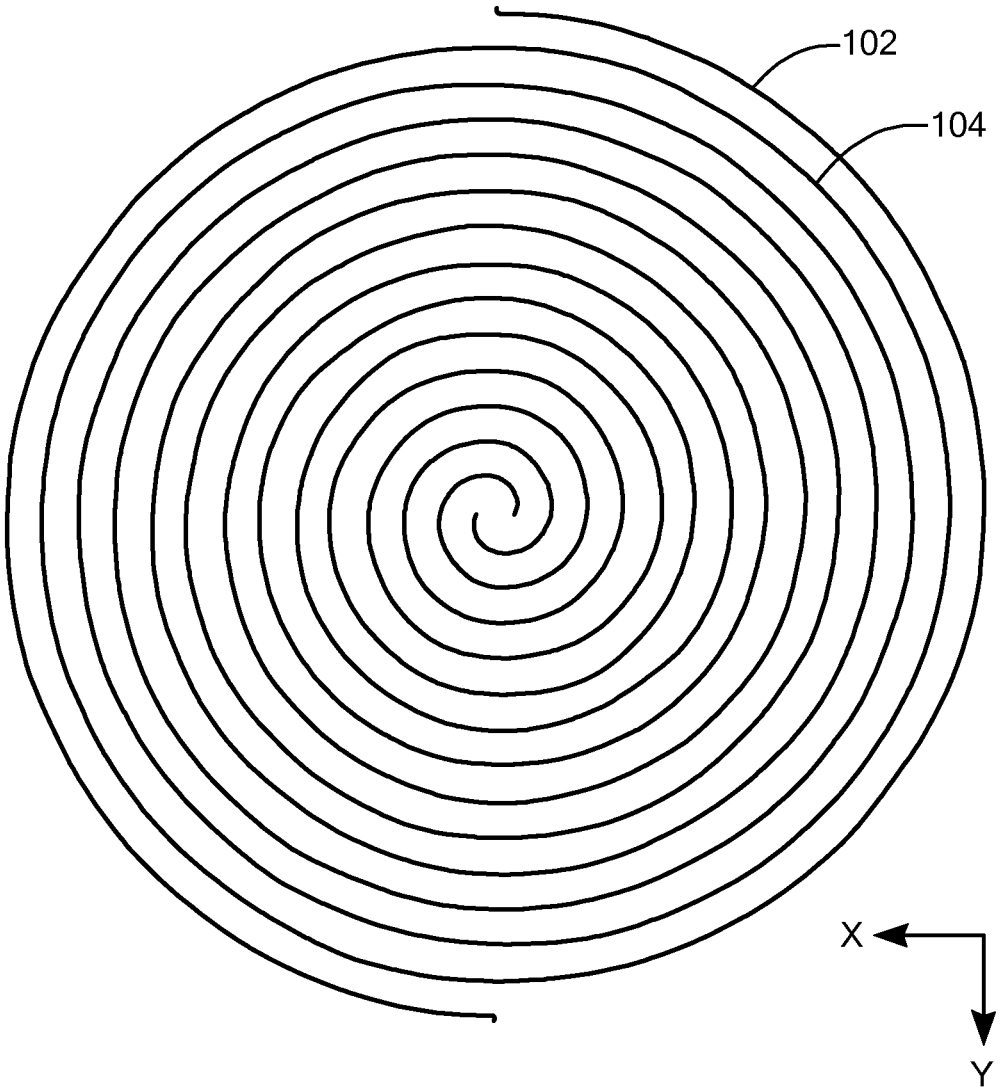
FIG. 2 (Prior Art)

FIGS. 1 and 2 are respective perspective and top schematic illustrations of a prior art spiral antenna 100. The spiral antenna 100 includes two spiral meandering driven elements 102 and 104. The driven elements 102 and 104 maintain a constant distance between arms of the spiral through each turn. Such a spiral is commonly referred to as an Archimedean spiral.

Some prior art spiral antennas have planar, i.e., flat, ground planes, as exemplified by planar ground plane 106. Heights, in the z direction, of the driven elements 102 and 104 above the ground plane 106 vary sinusoidally, and amplitudes of the sinusoids increase from the center of the spiral to the outer edge of the spiral. Consequently, although the spacing between the ground plane 106 and the driven elements 102 and 104 may be one-quarter wavelength at some points along the lengths of the driven elements 102 and 104, in most places, the spacing is sub-optimal for constructive interference, and in many places the spacing causes destructive interference.

Figure 3:
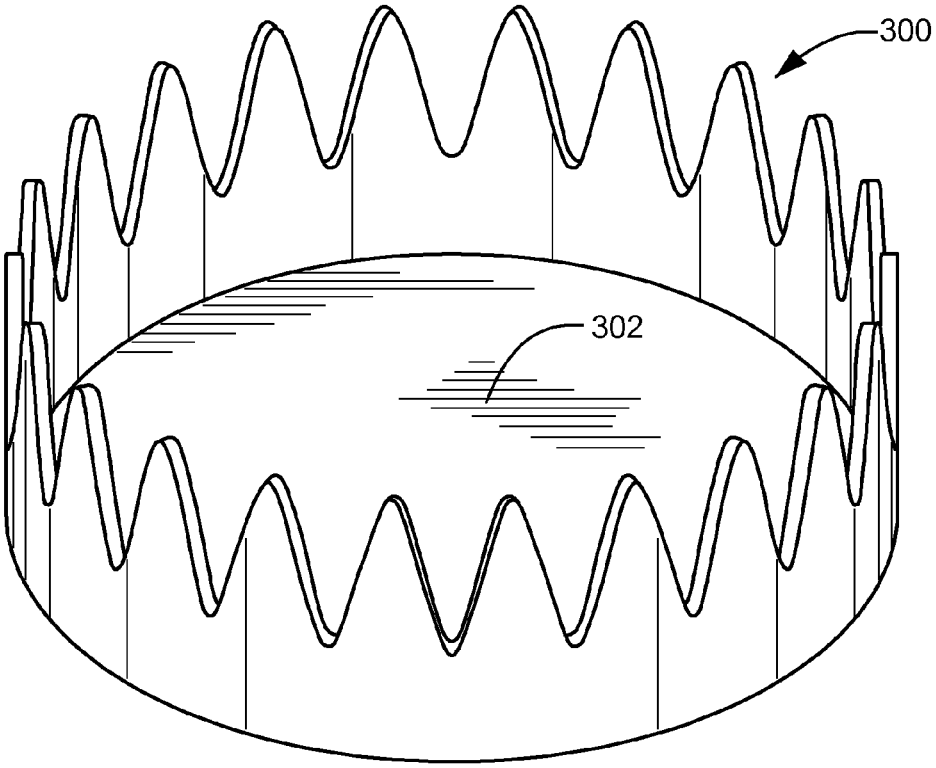
FIG. 3 (Prior Art)
FIGS. 3 and 4 are perspective and side schematic views, respectively, of a cavity for a spiral antenna having periodic sinusoidally corrugated driven elements, according to the prior art.
Figure 4:
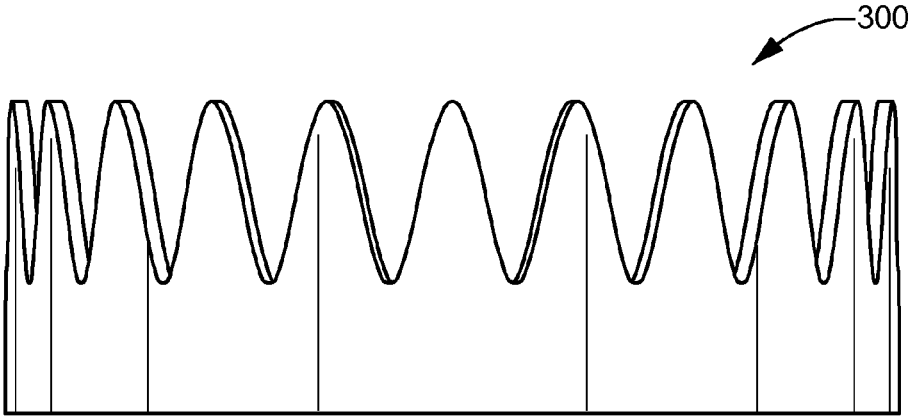
FIG. 4 (Prior Art)

FIGS. 3 and 4 are respective perspective and side schematic illustrations of a cavity 300 for a spiral antenna with periodic sinusoidally corrugated driven elements, as described by O'Brien. The spiral driven elements are not shown in FIGS. 3 and 4, but they are similar to the spiral driven elements 102 and 104 shown in FIGS. 1 and 2. The bottom 302 of the cavity 300 is flat.

Because shallow cavity spiral antennas are extremely broad band antennas, prior art reflectors (cavities and ground planes) are significantly flawed, in that their reflectors are located fixed distances from the planes of their driven elements. Because of this, reflected signals are not always in phase with desired forward signals and, for the majority of the desired frequency bands, the result is reduced forward boresight gain of the antennas. Spiral antennas with conical ground planes cannot accommodate driven elements that meander in the z direction, as illustrated in FIGS. 1 and 2, and provide quarter wavelength spacing for a range of frequencies.

Instead of using a flat or conical ground plane, embodiments of the present invention include ground planes that meander in the z direction, such that spacing between the ground planes and driven elements equal an odd multiple of one-quarter wavelength, along at least a portion of the length of the driven elements, thereby improving gain and bandwidth over a range of frequencies. The ground plane meanders in the z direction across at least a portion of the surface of the ground plane, not merely along its outer edge.

Figure 5:
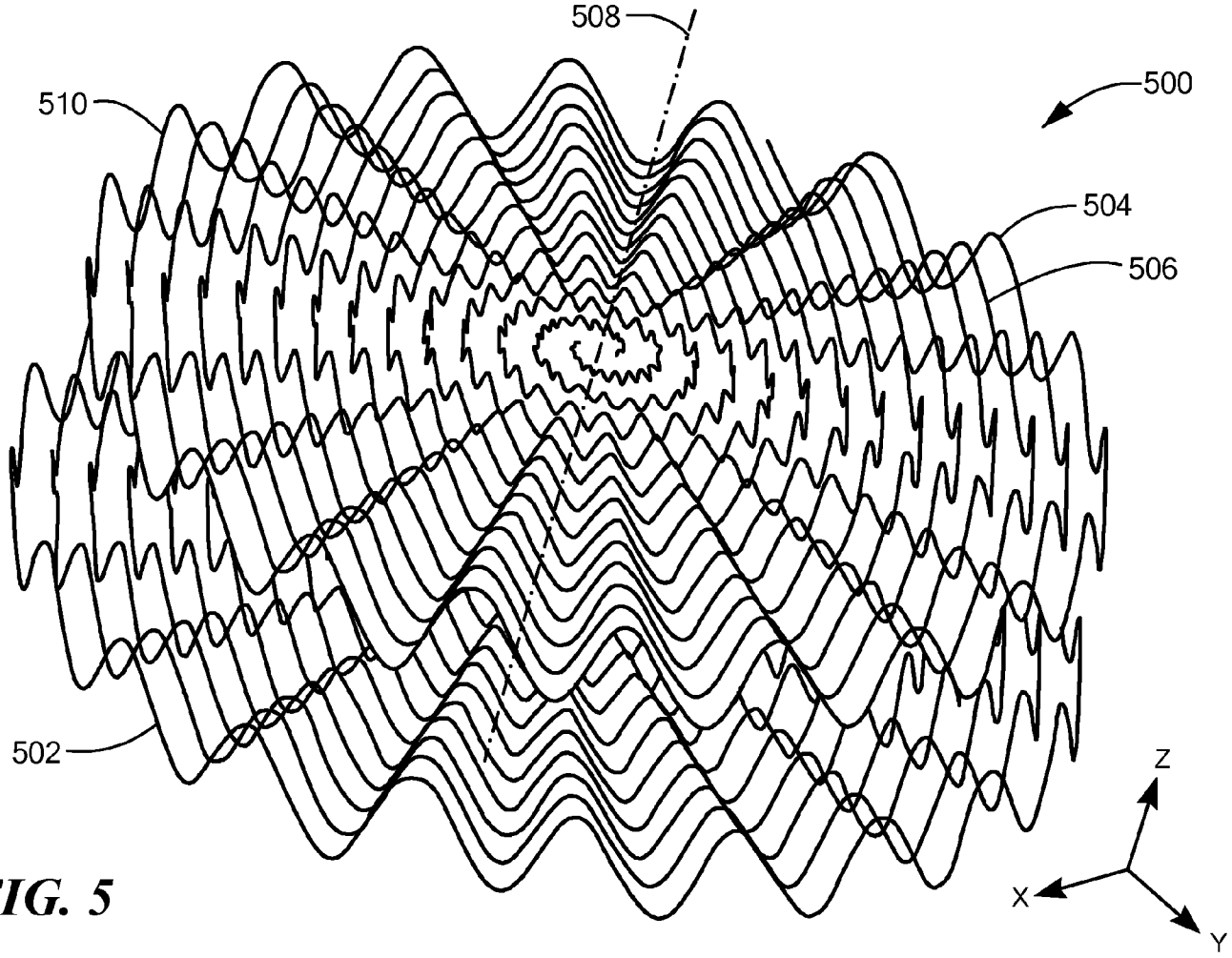
FIG. 5 is a perspective schematic view of a meandering spiral antenna having a ground plane that meanders in a z direction, according to an embodiment of the present invention.

FIG. 5 is a perspective schematic view of a meandering spiral antenna 500 having a ground plane 502 that meanders in a z direction, according to an embodiment of the present invention. Two spiral driven elements 504 and 506 are wound about a z axis 508. Each of the spiral driven elements 504 and 506 meander sinusoidally in the z direction. In other embodiments, the meander may be according to other functions.

The ground plane element 502 is parallel to, and spaced apart from, the plane of the driven elements 504 and 506. The ground plane 502 meanders in the z direction, such that the space between the ground plane 502 and the driven elements 504 and 506 is an odd multiple, such as 1, 3, 5, etc., of one-quarter wavelength at a design frequency of the antenna 500. This spacing provides about a 3 db gain over a spiral antenna without a ground plane. The ground plane 502 meanders, such that the quarter wavelength spacing is maintained, at least along a portion of the length of the spiral driven elements 504 and 506, including in a region intermediate an outside edge 510 of the ground element and the z axis 508. That is, the quarter wavelength spacing occurs not only about the periphery of the ground plane 502, as distinct from the cavity shown in FIGS. 3 and 4.

The ground plane 502 may be implemented by an electrically conductive wire, rod or other suitable element shaped as shown and described, with spaces between successive spiral turns. However, in other embodiments, the ground plane may be implemented by a flat conductive ribbon. FIG. 6 is a side schematic view of a spiral antenna 600 having z-direction meandering driven element 602 and a z-direction meandering ribbon ground plane 604.

Figure 7:
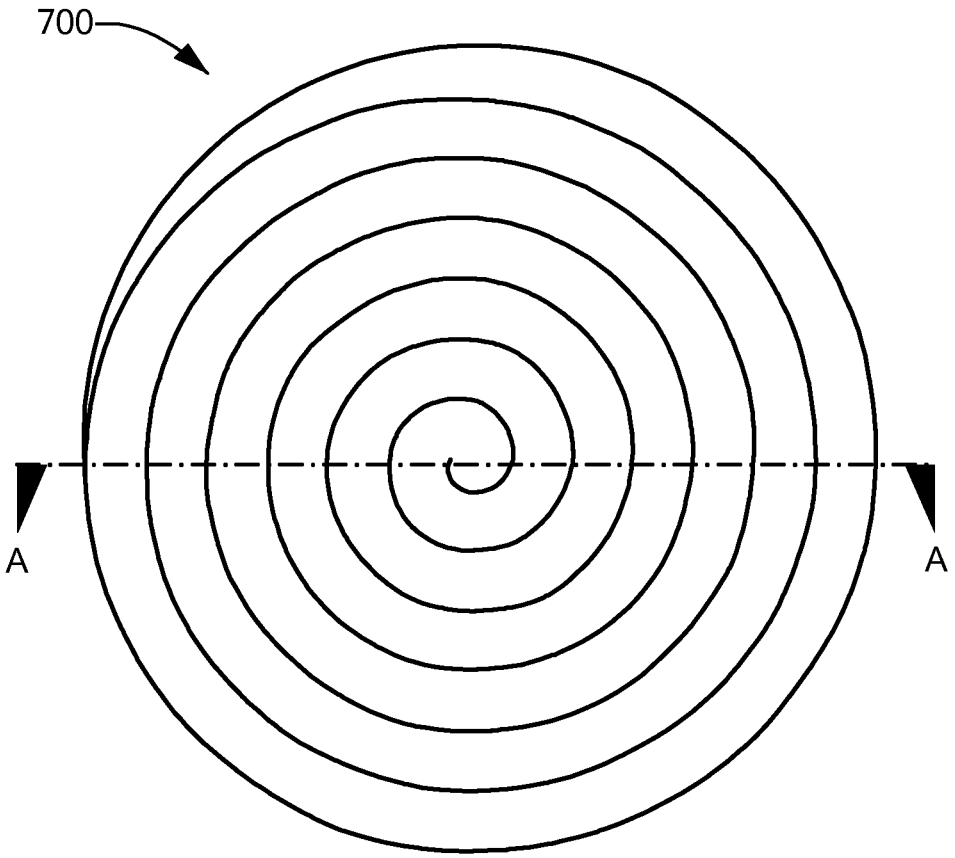
FIG. 7 is a top schematic view of a ground plane, according to an embodiment of the present invention.
Figure 8:
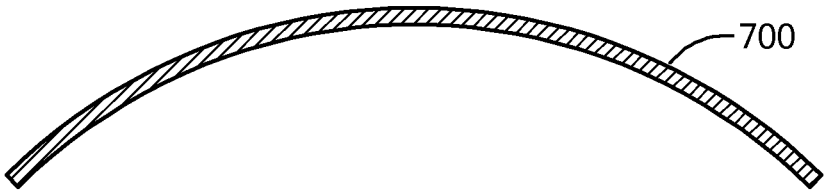
FIG. 8 is a schematic cross-sectional view of the ground plane of FIG. 7.

In yet other embodiments, the ground plane is implemented by a continuous, from center to edge, conductive sheet. FIG. 7 is a top schematic view of such a ground plane 700, and FIG. 8 is a schematic cross-sectional view of the ground plane 700.

Returning to FIG. 5, as noted, the ground plane meanders in the z direction, such that the space between the ground plane 502 and the driven elements 504 and 506 is an odd multiple of one-quarter wavelength at a design frequency of the antenna 500. The design frequency may encompass a range of frequencies, from a lower frequency to an upper frequency, for example from about 800 MHz to about 3 GHz. The distance between the ground plane 502 and the driven elements 504 and 506 varies along the spiral driven elements 504 and 506, such that the distance between the ground plane 502 and the driven elements 504 and 506 at any location along at least a portion of the spiral driven elements 504 and 506 is equal to about an odd multiple of one-quarter wavelength of a frequency between the upper frequency and the lower frequency. In the embodiment shown in FIG. 6, this variation in spacing may be seen as a general increase, from the center to an outside edge, in the spacing between the driven element 602 and the ground plane 604. The varying spacing between the ground plane 604 and the driven element 602 provides relatively consistent gain over the design frequency range of the antenna 600.

The variation in spacing may be smooth or stepped. In some embodiments, the distance between the ground plane 604 and the driven element 602 varies monotonically and continuously along the spiral driven element 602. In some embodiments (not shown), the distance between the ground plane and the driven element(s) varies monotonically and in steps along the spiral driven element.

In some embodiments, the space between the ground plane and the driven element(s) is taken up by air or the vacuum of outer space. Similarly, in some embodiments, the space between arms of the spiral driven elements is taken up by air or the vacuum of outer space. In other embodiments, a dielectric material, other than air, is disposed between the ground plane and the driven element(s). Polyetherimide (PEI), available under the trade name ULTEM, or other known microwave substrates are suitable dielectric materials. In some embodiments, the ground plane is attached to the dielectric material across at least a portion of the ground plane's surface area. The driven element may be attached to the dielectric material along at least a portion of the driven element's length. The dielectric material may maintain the distance between the ground plane and the driven element(s).

In some embodiments, both the amplitude and period of the sinusoidal shape of the driven elements increase along the lengths of the driven elements, from the center of the spiral toward its outer edges. In still further embodiments, the period of the sinusoidal shape increases linearly, such that the peaks and troughs of the various turns of the antenna radially align with each other.

Antennas according to embodiments of the present invention may be fed using conventional spiral antenna feed circuits.

While the invention is described through the above-described exemplary embodiments, modifications to, and variations of, the illustrated embodiments may be made without departing from the inventive concepts disclosed herein. Furthermore, disclosed aspects, or portions thereof, may be combined in ways not listed above and/or not explicitly claimed. Accordingly, the invention should not be viewed as being limited to the disclosed embodiments.

What is claimed is:

1. An antenna comprising:

a spiral driven element wound about a z axis and meandering in a z direction; and a ground element parallel to the driven element and meandering in the z direction along at least a portion of a length of the spiral driven element, including in a region intermediate an outside edge of the ground element and the z axis; wherein:

the antenna has a design frequency; and the ground element is spaced apart from the driven element a distance, measured along the z axis, equal to about an odd multiple of one-quarter wavelength at the design frequency such that a signal at the design frequency radiated by the driven element reflects off the ground element and then constructively interferes at the driven element with a subsequent signal radiated by the driven element.

2. An antenna according to claim a 1, wherein:

the design frequency comprises a range of frequencies extending from a lower frequency to an upper frequency; and the distance between the ground element and the driven element varies along the spiral driven element, such that the distance between the ground element and the driven element at any location along the spiral driven element is equal to about an odd multiple of one-quarter wavelength of a frequency between the upper frequency and the lower frequency.

3. An antenna according to claim 2, wherein the distance between the ground element and the driven element varies monotonically and continuously along the spiral driven element.

4. An antenna according to claim 2, wherein the distance between the ground element and the driven element varies monotonically and in steps along the spiral driven element.

5. An antenna according to claim 1, wherein:

the design frequency comprises a range of frequencies extending from a lower frequency to an upper frequency; and the distance between the ground element and the driven element varies along the spiral driven element, such that, for each frequency of a plurality of frequencies between the lower frequency and the upper frequency, the distance between the ground element and the driven element is equal to about an odd multiple of one-quarter wavelength of the frequency at one or more locations along the spiral driven element.

6. An antenna according to claim 5, wherein the distance between the ground element and the driven element varies monotonically and continuously along the spiral driven element.

7. An antenna according to claim 5, wherein the distance between the ground element and the driven element varies monotonically and in steps along the spiral driven element.

8. An antenna according to claim a 1, wherein:

the design frequency comprises a range of frequencies extending from a lower frequency to an upper frequency; and the distance between the ground element and the driven element varies along the spiral driven element, such that the distance varies between about an odd multiple of one-quarter wavelength of the upper frequency to about an odd multiple of one-quarter wavelength of the lower frequency.

9. An antenna according to claim 1, further comprising a dielectric material, other than air, disposed between the ground element and the driven element, the ground element being attached to the dielectric material across at least a portion of the ground element's surface area, the driven element being attached to the dielectric material along at least a portion of the driven element's length and the dielectric material maintaining the distance between the ground element and the driven element.

* * * * *